US009743717B2

(12) United States Patent
Custer

(10) Patent No.: US 9,743,717 B2
(45) Date of Patent: Aug. 29, 2017

(54) EXCHANGEABLE BELT BUCKLE

(71) Applicant: James Robert Custer, Mount Pleasant, MI (US)

(72) Inventor: James Robert Custer, Mount Pleasant, MI (US)

( * ) Notice: Subject to any disclaimer, the term of this patent is extended or adjusted under 35 U.S.C. 154(b) by 0 days.

(21) Appl. No.: 14/953,699

(22) Filed: Nov. 30, 2015

(65) Prior Publication Data

US 2017/0150787 A1 Jun. 1, 2017

(51) Int. Cl.

| | |
|---|---|
| ***A44B 11/22*** | (2006.01) |
| ***A44B 11/04*** | (2006.01) |
| ***A44B 11/00*** | (2006.01) |
| ***A41F 9/00*** | (2006.01) |

(52) U.S. Cl.

CPC ..... *A44B 11/22* (2013.01); *A41F 9/002* (2013.01); *A44B 11/006* (2013.01); *A44B 11/04* (2013.01)

(58) Field of Classification Search

CPC ... Y10T 24/4026; A44B 11/22; A44B 11/006; A44B 11/04; A41F 9/002

See application file for complete search history.

(56) References Cited

U.S. PATENT DOCUMENTS

| | | | | |
|---|---|---|---|---|
| 4,502,188 A * | 3/1985 | Kohli | ..... | A44B 11/001 24/163 K |
| 5,127,136 A * | 7/1992 | Magnus | ..... | A44B 11/226 24/176 |
| 5,357,638 A * | 10/1994 | Mayzel | ..... | A44B 11/005 2/312 |

* cited by examiner

*Primary Examiner* — Robert J Sandy

(57) ABSTRACT

An exchangeable belt buckle that allows the user to change the belt configuration as well as belt color. It also allows for the buckle to be interchangeable. The ability to reconfigure the belt and the buckle gives the user nearly unlimited fashionable appearances.

1 Claim, 5 Drawing Sheets

EXCHANGEABLE BELT BUCKLE

BACKGROUND OF THE INVENTION

Belt buckles are not new to the art. However, in the present invention the housing allows the belt to be worn in two distinct positions that allow for a belt end to cover the belt or for the belt end to hide behind the belt.

When combined with a reversible color belt or belts of varying colors, different buckles give the user unlimited variations. It has been discovered that this belt and buckle combination that provides a sleek looking design and the convenience of quickly changing the look. The novel way that the buckle attaches to the belt allows for the end of the belt to cover the belt or to hide behind the belt. This allows each belt and buckle combination four different configurations to wear it. By just adding a belt here and a buckle there the combinations that are available to the user are almost endless.

THE INVENTION

The present invention is an exchangeable belt buckle. The belt buckle comprises in combination a first component, the first component is a flat trapezoidal plate. This plate has at least one threaded through hole therein.

There is a second component that comprises a flat plate that has a first end and a second end. The first end has a pin vertically mounted on a back surface of the flat plate.

There is also a housing surmounted on the back surface near the second end. The housing contains a second horizontal opening surmounted over a first horizontal opening.

DETAILED DESCRIPTION OF THE DRAWINGS

Figure 1:
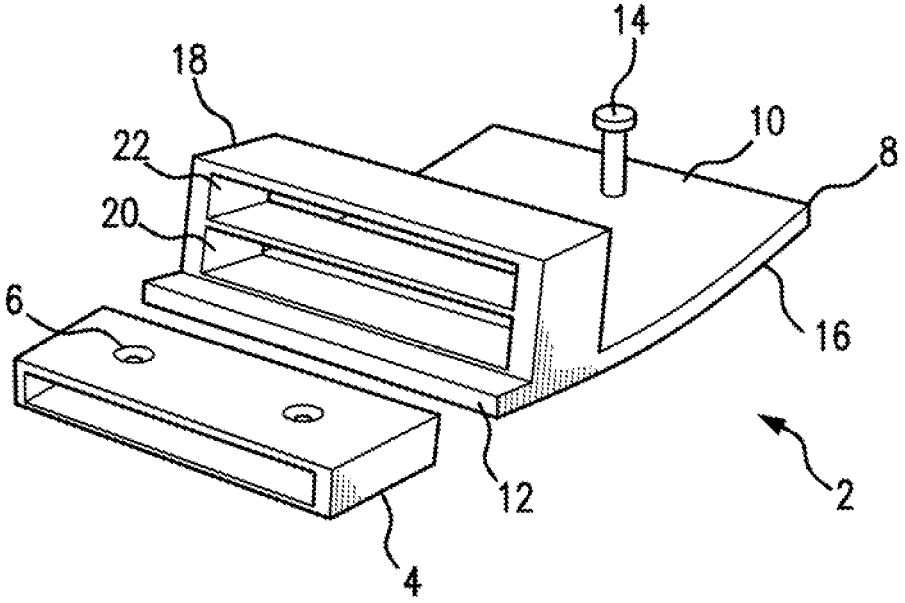
FIG. 1 shows an end view of the first and second components.

FIG. 1 shows the exchangeable belt buckle 2 with its first component 4 and second component 8 as an end view. The first component 4 has threaded openings 6 therethrough.

The second component 8 has a first end 10 and a second end 12. The second component 8 also has a back surface 16 that has a vertical pin 14 near its first end 10. The second component 8 also has a housing 18 near its second end 12. This housing 18 has a first horizontal opening 20 and a second horizontal opening 22.

Figure 2:
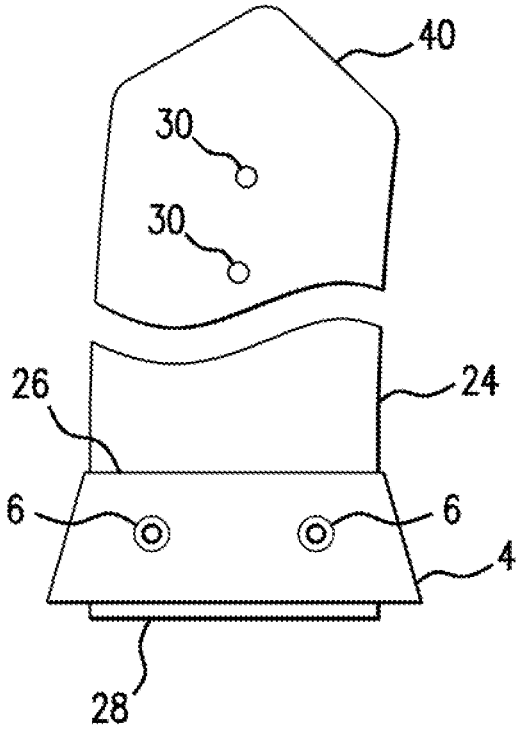
FIG. 2 shows an end view of the first component attached to a belt.

FIG. 2 shows the first component 4 attached to a belt 24. The first component 4 is trapezoidal with its first end 26 being slightly narrower than its second end 28. This trapezoidal shape is crucial in that it has been discovered that when the first component is attached to a belt 24 and fed into one of the horizontal openings 20 or 22 of the housing 18 the belt 24 will lock into place within the housing 18 and be securely held in place. This aspect gives the present invention a greater utility over any other prior art device. The first component 4 has a first end 26 that the belt 24 attaches through. The belt first end 40 has openings 30 to secure the vertical pin 14 to the belt 24.

Figure 3:
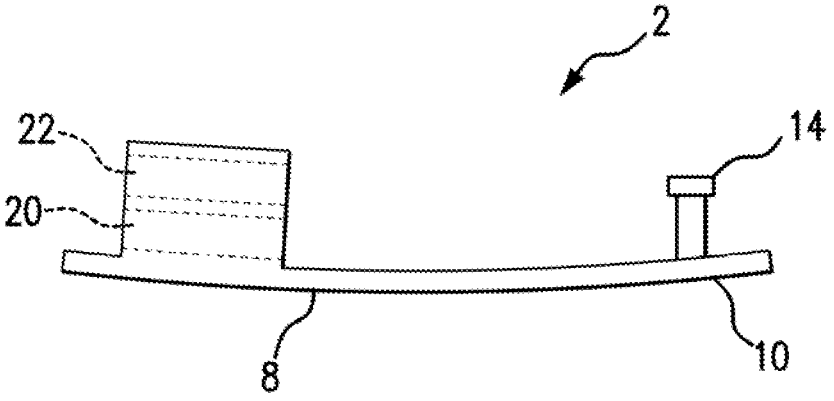
FIG. 3 shows a full side view of the second component.

FIG. 3 shows the second component 8 from the side. The belt buckle 2 is slightly curved to conform to the human body. This figure shows the vertical pin 14 near the first end 10 of the second component 8. The pin 14 provides a means to secure the belt 24 to be belt buckle 2. The belt 24 has openings 30 therethrough to secure the belt first end 40 to the buckle 2, This figure shows the housing 18 of the second end 12 of the second component 8. Also shown are the first horizontal opening 20 and the second horizontal opening 22.

Figure 4:
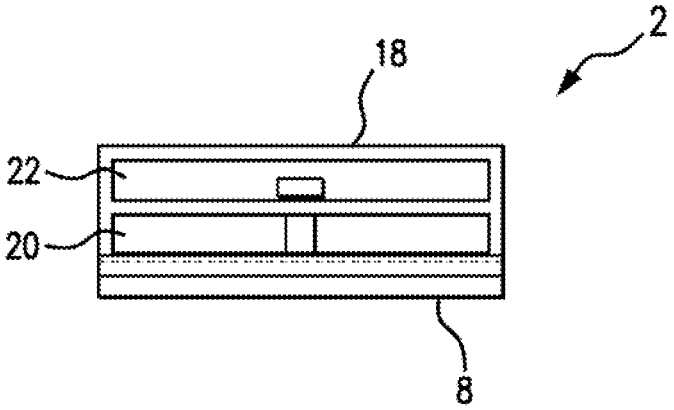
FIG. 4 shows a full end view of the second component.

FIG. 4 shows the second component 8 from the end. It has been discovered that the first horizontal opening 20 and the second horizontal opening 22 give the belt buckle 2 a greater utility over any prior art buckle, in that, the belt 24 slides first through the first horizontal opening 20 allowing the belt first end 40 to slide through the second horizontal opening 22 thus hiding the belt 24 behind itself. This is one look. If the belt 24 is passed through the second horizontal opening 22 and then the belt 24 passes through the first horizontal opening 20 it exposes the belt first end 40 beyond the buckle 2. This is the second look. This gives the buckle 2 dual utility from the same buckle 2 without changing the buckle 2.

Figure 5:
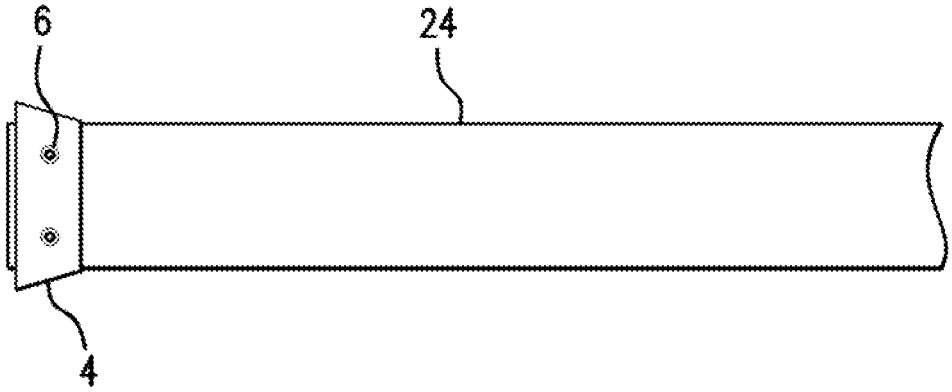
FIG. 5 shows a full top view of the first component.

FIG. 5 shows the first component 4 from the top. The trapezoidal shape allows the first component 4 to move into the second component 8 and lock into the second component 8 because of the trapezoidal shape. This aspect gives the belt buckle 2 a greater utility over any prior art because the configuration can be easily changed.

Figure 6:
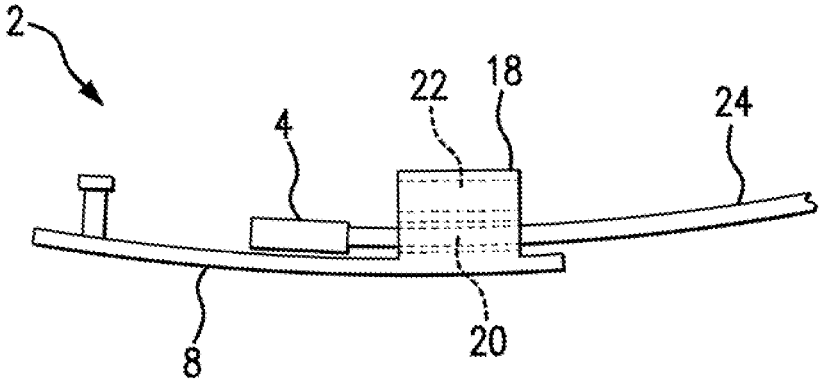
FIG. 6 shows a full side view of the second component.

FIG. 6 shows the second component 8 housing 18 from the side. Once again if the belt 24 is passed through the first horizontal opening 20 then the first end 40 of the belt 24 passes through the second horizontal opening 22 it hides the first end 40 of the belt 24 behind the rest of the belt 24.

Figure 7:
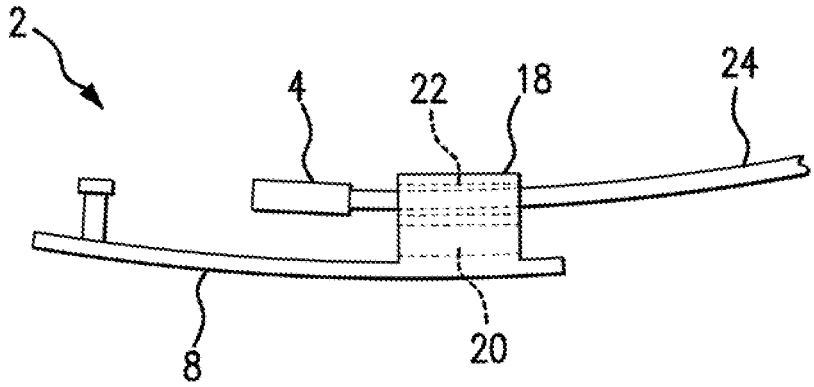
FIG. 7 shows a full side view of the second component.

FIG. 7 shows the second component 8 housing 18 from the side. Here is the other look that results from passing the belt 24 through the second horizontal opening 22 then passing the first end 40 through the first horizontal opening 20 allowing the first end 40 of the belt 24 to be exposed.

Figure 8:
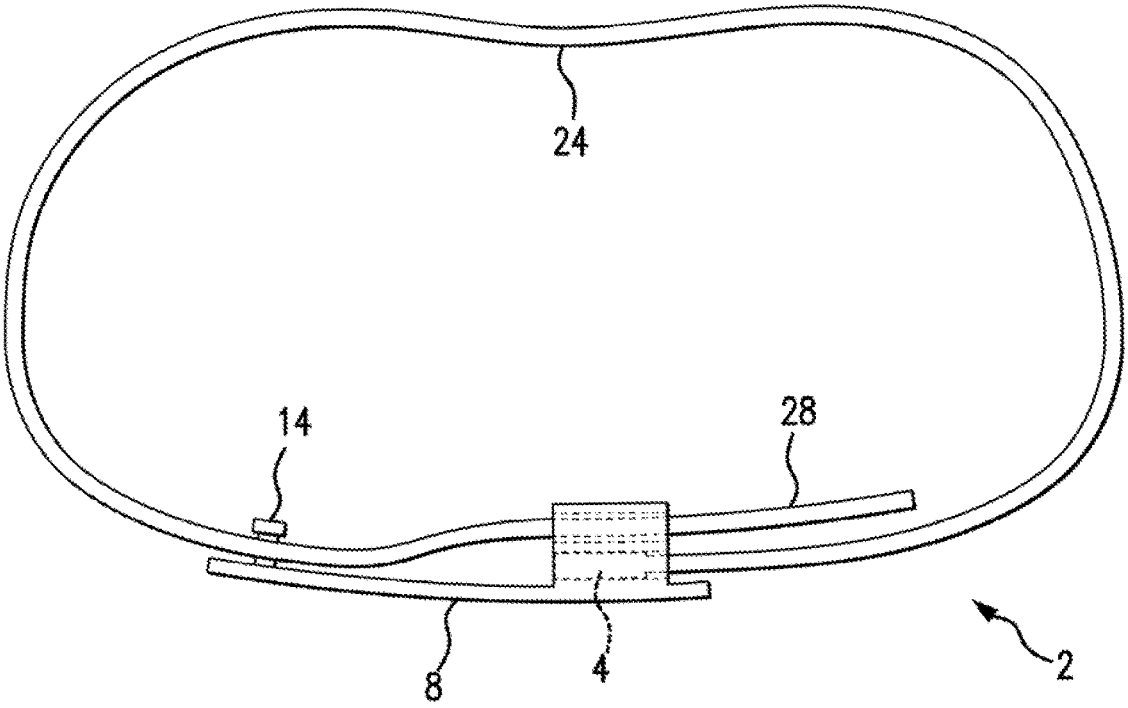
FIG. 8 shows the first component and the second component with the belt end hidden.

FIG. 8 shows the first component 4 and the second component 8 with the belt end 40 hidden.

Figure 9:
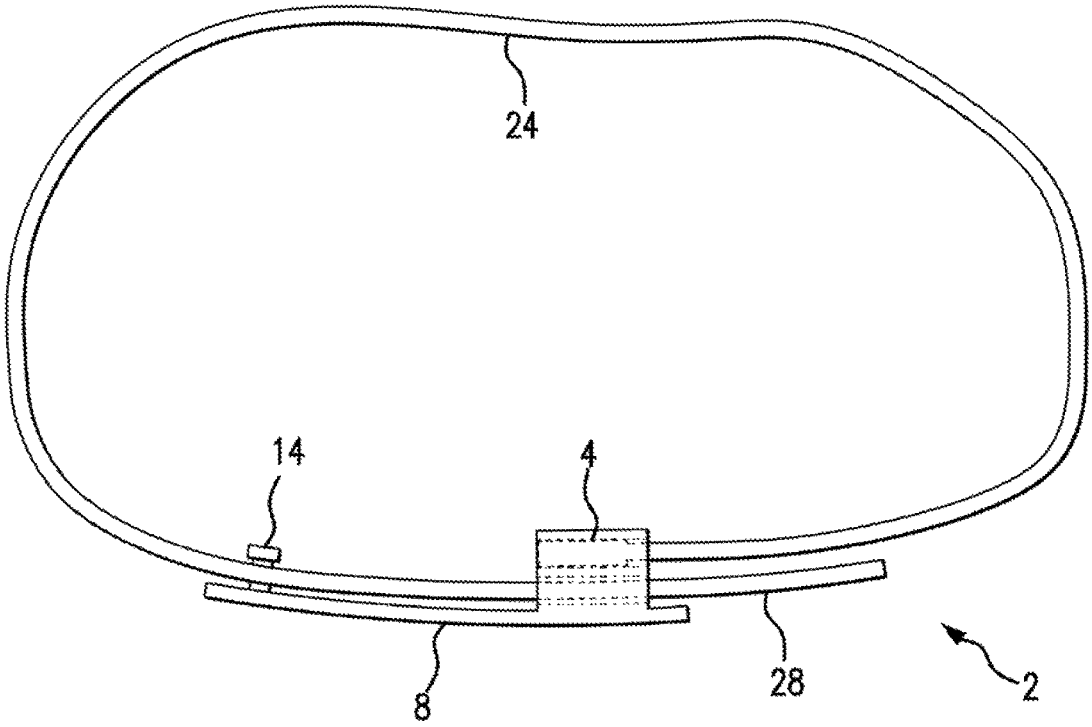
FIG. 9 shows the first component and the second component with the belt end exposed.

FIG. 9 shows the first component 4 and the second Component 8 with the belt end 40 exposed.

The exchangeable belt buckle is capable of giving different appearances from a single belt buckle. This allows the user to have unlimited fashionable looks with the belt 24 that has a different colors on each side, and buckles 2 of various configurations.

What is claimed is:

1. An exchangeable belt buckle, said belt buckle comprising in combination:

i. a first component, said first component being a flat trapezoidal plate, said plate having at least one threaded through hole therein for attaching one end of said belt, ii. a second component comprising a flat plate having a first end and a second end, said first end having a pin vertically mounted on a back surface of said flat plate, said pin securing said second component to one of the said openings of said first end of said belt;

iii. a housing surmounted on said back surface near said second end, said housing containing a second horizontal opening positioned over a first horizontal opening said flat trapezoidal plate allowing the feeding of said belt into one of the said two horizontal openings of the housing to lock one end of said belt into place within the housing to secure said belt end in place.

* * * * *